US006439611B1

(12) United States Patent
Chen

(10) Patent No.: US 6,439,611 B1
(45) Date of Patent: Aug. 27, 2002

(54) FILE FOLDER, BOX AND PANEL DESIGNED WITH PRE-PERFORATED HOLES, GROOVES AND SLOTS

(76) Inventor: Hung-Wei Chen, PO Box 82-144, Taipei (TW)

( * ) Notice: Subject to any disclaimer, the term of this patent is extended or adjusted under 35 U.S.C. 154(b) by 0 days.

(21) Appl. No.: 09/694,830

(22) Filed: Oct. 24, 2000

(51) Int. Cl.[7] ..... B42D 17/00

(52) U.S. Cl. ..... 281/29; 402/73; 402/70; 281/37; 281/45

(58) Field of Search ..... 402/4, 79, 80 P, 402/80 R, 70, 73; 281/29, 36, 37, 45

(56) References Cited

U.S. PATENT DOCUMENTS 1,895,174 A * 1/1933 Schonts ..... 402/4
5,190,127 A * 3/1993 Cummings ..... 402/4 X
5,713,551 A * 2/1998 Doerner ..... 402/4 X

* cited by examiner

*Primary Examiner*—William Fridie, Jr.
(74) *Attorney, Agent, or Firm*—Leong C. Lei

(57) ABSTRACT

A novel file folder, box and panel designed with pre-perforated holes, grooves and slots where the file folder at least comprises two pieces of panel, on which a plurality of holes, grooves, slots, and border indentations are pre-perforated. The file folder panel has at least a flap on its periphery. The pre-perforated holes, grooves and slots are fit for installing a variety of file clips. The pre-perforated holes and slots also permit fixing and winding the elastic trap. The flap, after being erected up in place, allows the file clip and elastic trap to band together. The invention provides a separate design of file folder panels and file clips to form varying combinations, functions and economical benefits as the end-user desires.

1 Claim, 19 Drawing Sheets

FILE FOLDER, BOX AND PANEL DESIGNED WITH PRE-PERFORATED HOLES, GROOVES AND SLOTS

BACKGROUND OF THE INVENTION

1. Field of the Invention

This invention provides a file folder, box and panel designed with pre-perforated holes, grooves and slots in which file panels and file clips are separately designed. The file clips are selective depending what the type of file folders are used. The separation of file folders from the file clips renders easy environmental recycling and resource reusing in later time.

2. Description of the Related Art

The prior art of most file folder panels and file clips are permanently fixed, impermissible for disassembly and replacement. It offers a si with limited function.

When the file folder panel and the file clip are holding a plurality of paper, and while the file folder is horizontally placed, it usually happens in this way that the document paper will be inclined on the account of gravity, and eventually get loose.

In most cases, the file folder panels are of plastic material, and the file clips, the metal material. Once the file folder panel becomes obsolete, since the file folder panel and the file clip are bound permanently together, will create an environmental problem because it is hard to recycle.

BRIEF SUMMARY OF THE INVENTION

The file folder panel can be designed in the term of single, double, treble or multi-panel, with a plurality of holes, grooves, slots pre-perforated on the panel, the indentations on the panel edge and a flap extended on the panel top border. The pre-perforated holes, grooves and slots are capable of being fixed by many kinds of file clips (such as D clamp, German clip, Spring clip, go-through clip, hole clip, etc.) The pre-perforated holes and slot on the file panel allows binding and winding with elastic trap, the groove for the clamp band to go through. The edge flap, after erected properly, provides pre-perforated holes and groove as a passage for the file clips to hold the paper documents.

The invention realizes the following achievements:

(1) The file shell and the file clip are a separate design, where the shell (the file folder panel) permits being flatly piled up to save much of space in storage and transportation. The users will buy the file clips for self-erection at an adequate quantity without an excessive stock. When the file folder panel is worn out, the file clip can be reused on the new file folder panel. The worn shell and document paper can be recycled for regeneration.

(2) The holes, grooves, slots and indentations pre-perforated on the file folder panel offer the user a wide range of selecting the file clips, convenient to erect and easy to adjust the file folder.

(3) The file folder panel furnishes easy relocation of the file clips, suitable both for Chinese and Western document patterns.

(4) single file folder panel, erected with a plurality of file clips, conducive to holding different sizes of document paper.

(5) Besides the file folder, it can work as handwriting board and drawing board, suitable for carrying along on the outdoor work.

DETAILED DESCRIPTION OF THE INVENTION

Figure 1:
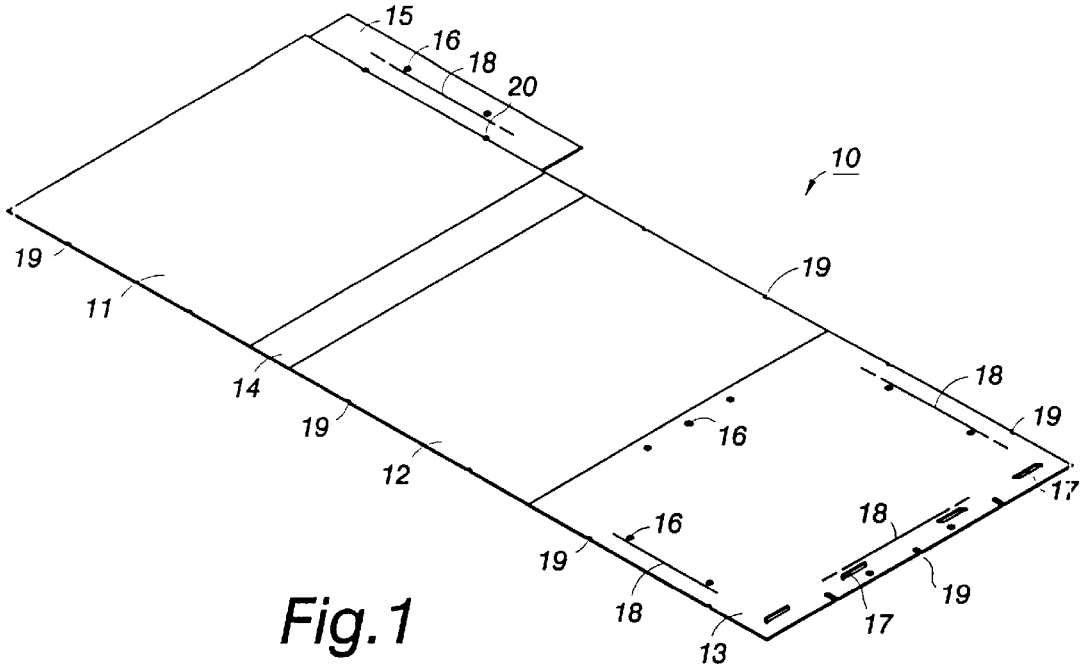
FIG. 1 shows the extension diagram of the file folder panel (1) of the invention.

The invention is exemplified in greater detail with the aid of the drawing as described below.

FIG. 1 is an extended drawing of the file folder panel of this invention, where the file folder can be in single, double, treble and multiple panels. For easy understanding, the file folder panel 10 is composed of three main panels, 11, 12, 13 and a small size panel which goes between the panels 11 and 12 and serves as a spine. These three panels 11, 12, and 13 are outfitted an extended flap 15 on the top border. The figure only illustrates a flap on the border of panel 11. Of three panels 11 through 13 are the file clip boards, and the flap 15 forms a file clip region. The purpose of the file clip boards and the file clip region is to accommodate all kind of file clips.

Figure 4:
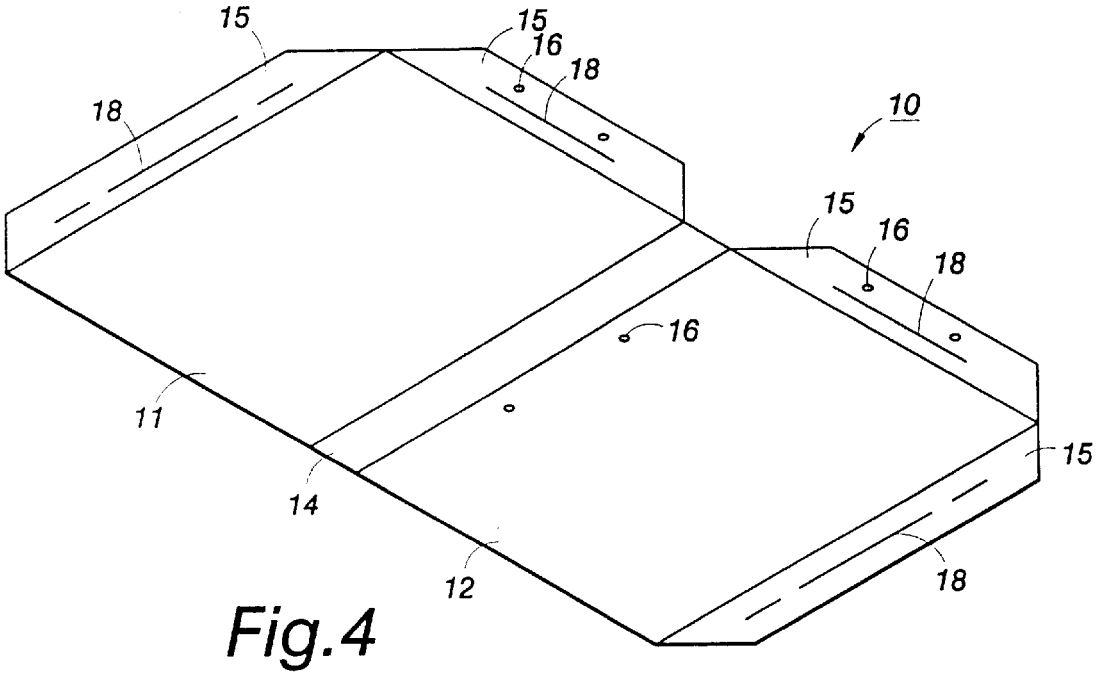
FIG. 4 shows the extension diagram of the file folder panel (2) of the invention.

Please refer to FIG. 4 where the file folder board 10 consists of two main panels 11, 12, a spine 14 interposed between two main panels and two flaps 15 on the top border of two main panel. It also permits to outfit a third flap 15 there (not shown in the Figure.) Two panels form the file clip board and the flap serves as the clip region.

Ass shown in FIGS. 1 and 4, the flap provides a plurality of pre-perforated holes 16, slots 17, grooves 18 and edge indentations 19 at unspecified places, suitable to fit many forms of clips in different sizes, (such as go-through clips, loose leaf clip, German clip, strong clip and etc.).The more the holes, grooves, slots and openings perforated on the panel, it is easier to contain any size of different clips. However, when the holes, grooves, slots and openings are too numerous, it will hurt the strength of the file folder panel 10. An adequate quantity of holes, grooves and slots set up on panels benefits the file folder panel 10. The flap 15 also provides a plurality of holes 20 on the crease. The number of holes, grooves, slots and openings are punched as desired to fit the optional positions of the file clips.

Figure 5:
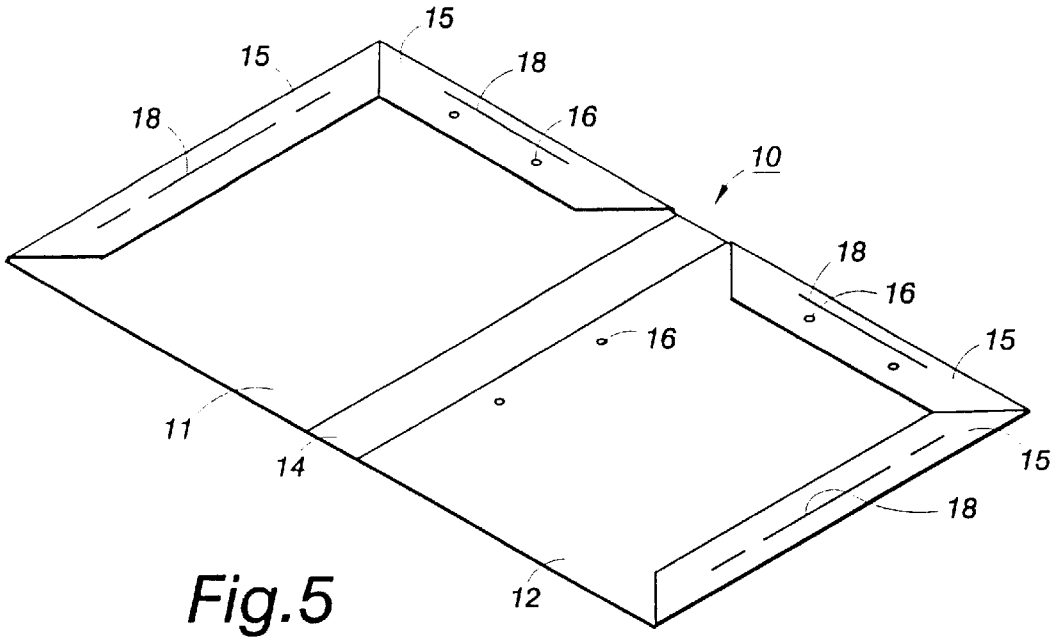
FIG. 5 illustrates the fold up diagram of the file folder panel (2) of the invention.
Figure 6:
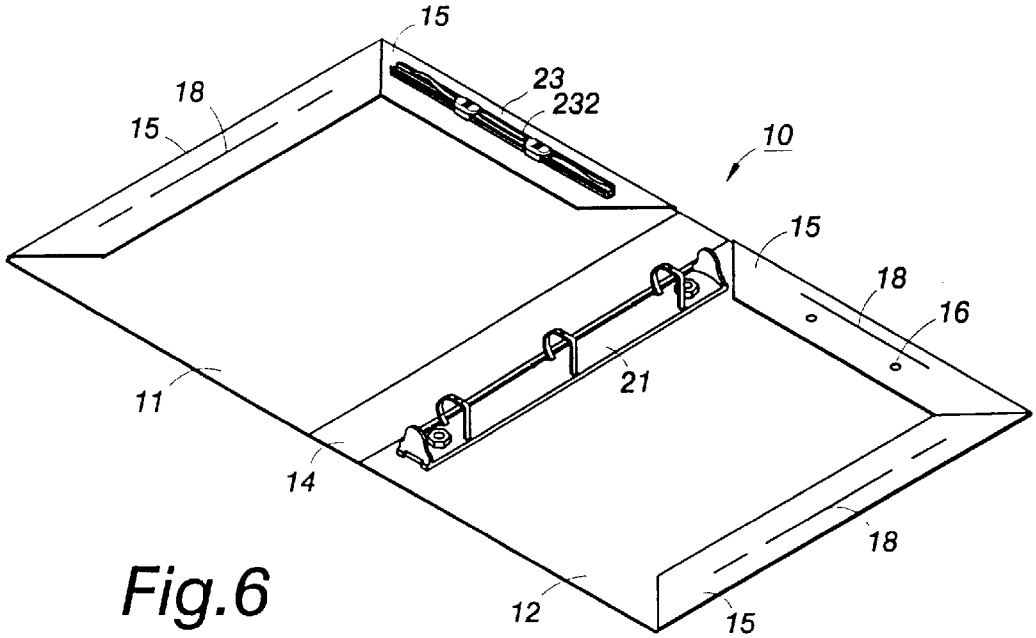
FIG. 6 displays the file folder panel (2) of the invention mounted with file clip.

FIG. 5 shows a fold-up diagram of the file folder panel 10 from FIG. 4. Where four pieces of flap are folded back onto the panels 11 and 12. The holes, grooves slots and indentations punched on the panel are suitable for installing any form of clips.

Figure 2:
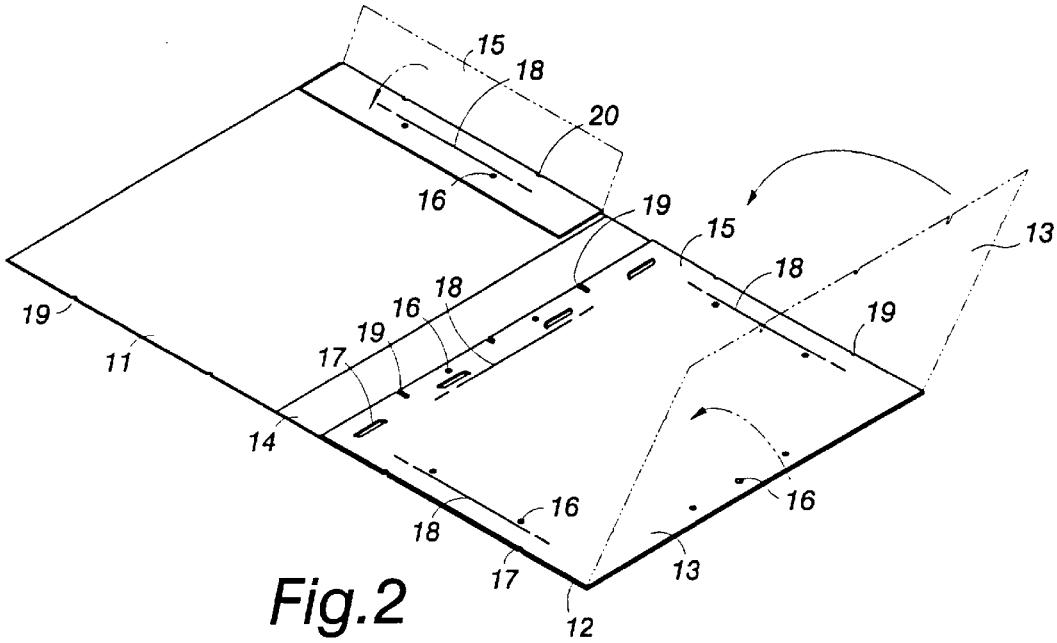
FIG. 2 illustrates the fold up diagram of the file folder panel (1) of the invention.
Figure 3:
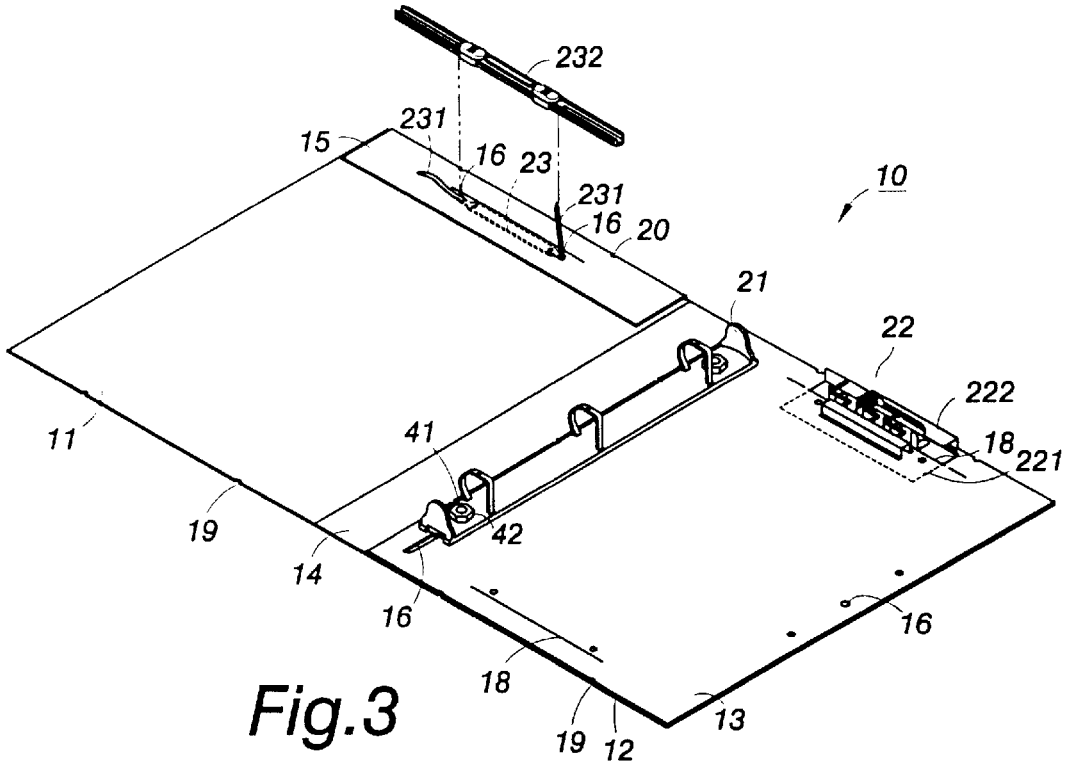
FIG. 3 displays the file folder panel (1) of the invention mounted with file clip.
Figure 7:
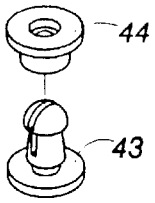
FIG. 7 shows the snap with stud and socket of the invention
Figure 8:
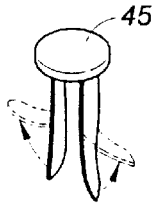
FIG. 8 displays the stereo diagram of the staple of the invention.
Figure 10:
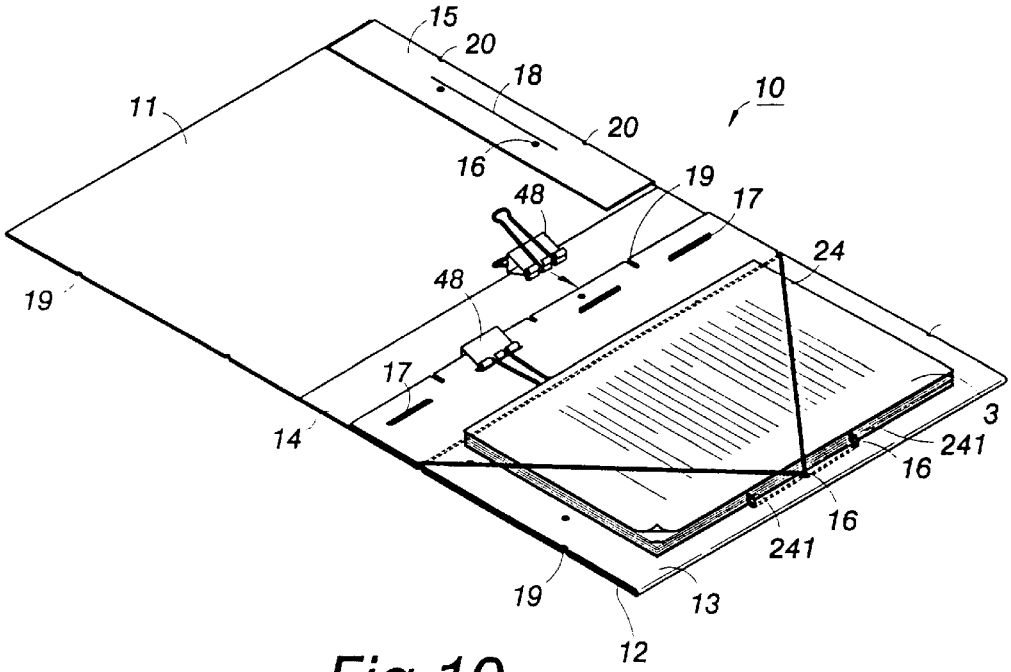
FIG. 10 displays the document paper is held by the elastic and on the file folder panel (1).

FIG. 3 illustrates the file folder panel 10 as shown in FIG. 2 along with file clips installed. Where panel 13, hole 16 or slot 17 are installed with loose leaf clips, fixed in place with fixing element such as bolt 41 and nut 42 on the panel 13. There are many kind of fixing element available. The commonest fixing elements as shown in FIG. 7 are plastic snap consisting of stud 43 and socket 44, or the metal staple 45. In addition, the panel 13 and the slot 18 as shown in FIG. 3 provides for installing strong clip 22 with clip band 221 pressed and fixed in place under the spring rod 222. The pre-perforated hole 16 on the flap 15 offers for mounting two legs 231 of the go-through clip 23, and the legs 231 are pressed in place by the presser 232. As shown in FIG. 10, the slot 17 is for mounting the band slip 48 with serrated teeth band to hold the document paper firmly. The slot can be cut in one section or multiple sections, it is preferably to have two sections and three section cut. As shown in FIGS. 1, 2 and 3, the slot 18 forms in three sections, in which the side sections are longer than the central section. The central section is for mounting small sized strong clip 22 (about 10 cm long.) If the larger sized strong clip 22 (about 15 cm long) is used, the art knife is employed to cut three section into one long slot. When the small-sized file clip is applied for the clip board and clip region, no art knife is required to cut the sections into a long slot. To ensure the inherent strength of the clip board and the clip region. Viewing from the aforementioned statement, it is fully understood that the file folder panel of this invention is suitable for mounting any kind of file clip as the user desires, the file clip is optional for change, addition, deletion and interchange. Even on the same file, several file clips can be used together.

Figure 9:
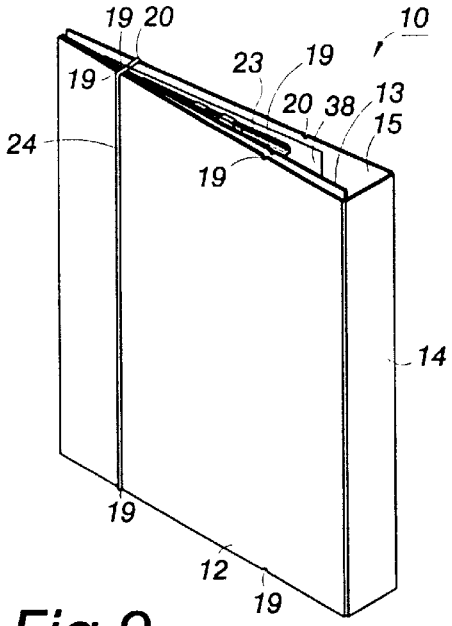
FIG. 9 shows the file folder panel (1) mounted with elastic band

Please refer to FIG. 9 where the file folder panel 10 from FIG. 3 combines with file clip and paper 38 to form a closed data folder. The file folder holds the paper together, never getting loose by binding an elastic band 24 which passes through the indentation 19 and the hole 20. The elastic band effects the shrinking force to hold the file folder panel 10 and paper 38 together.

To prevent the gravity inclination taking place on the paper 38 when the file folder panel 10 is placed horizontally, as shown in FIG. 10, a band knot 241 of the elastic band will be confined in the central hole 19, both ends of the elastic band extend diagonally to the border indentation to form a triangle to hold the paper 38 in place without movement and loosen. Alternatively, two file clips are employed on the upside or downside to keep the paper gravity in balance.

Figure 11:
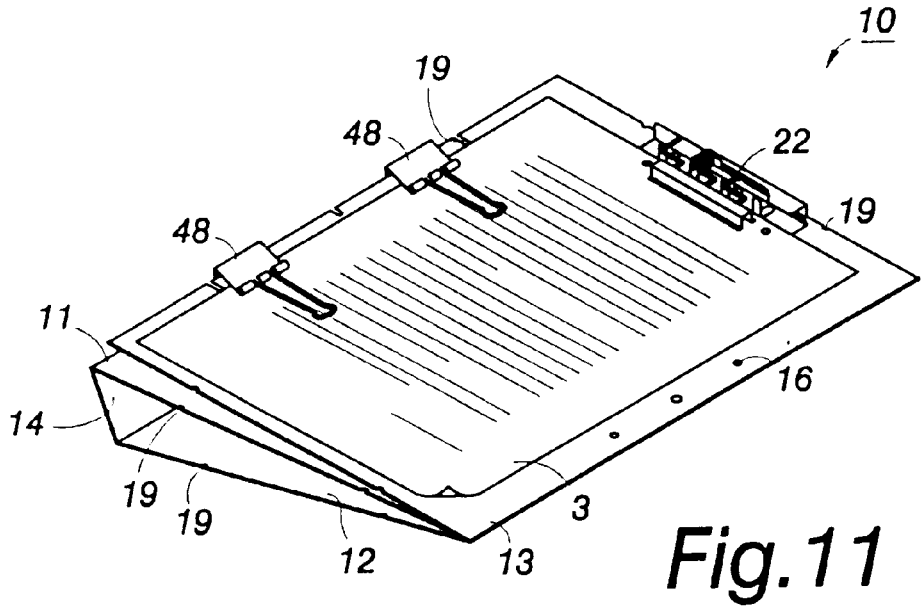
FIG. 11 demonstrates another embodiment of the file folder panel (1).

FIG. 11 demonstrates another fold-up of file folder panel 10, in which the panel 11 is inwardly folded and the panel 13 is folded on the top of the panel 11, the paper 38 is held by the strong clip 22, serving as copy board and writing board, easy to operate.

Figure 12:
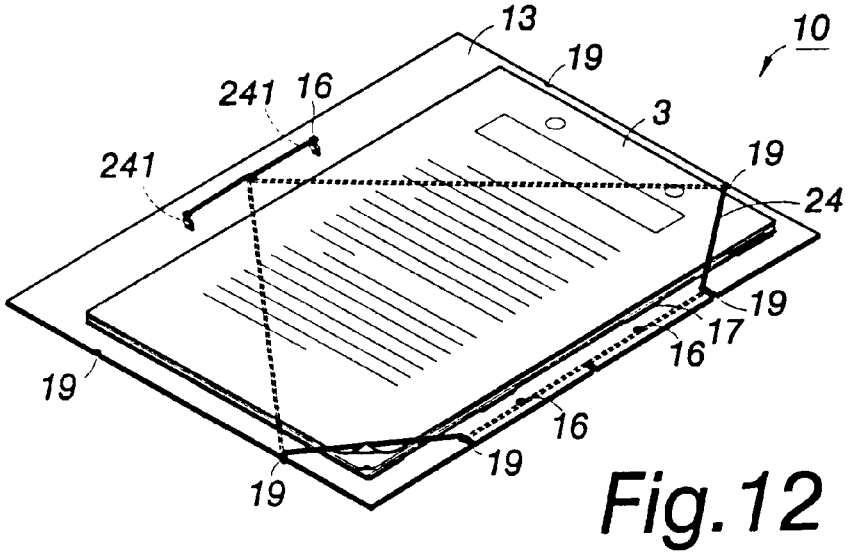
FIG. 12 shows the file folder panel (3) mounted with elastic band

FIG. 12 illustrates an embodiment of a single file panel, similar to the main file panel 13 as aforementioned, it has a pre-perforated hole 16, several slots 19 and an elastic band 24 to hold the paper 38 in place.

Figure 13:
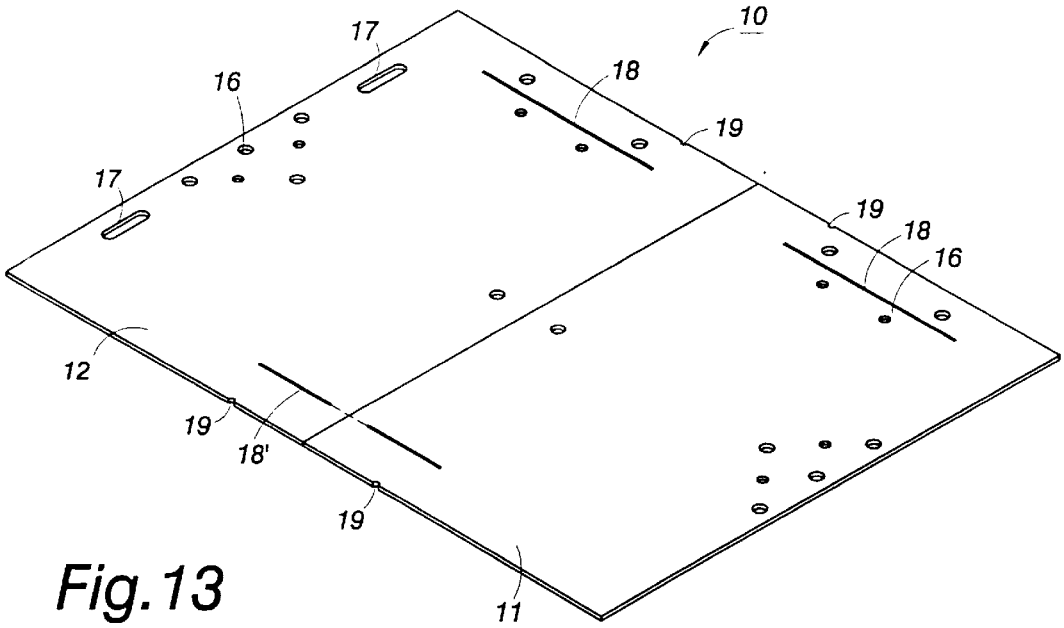
FIG. 13 shows the extension diagram of the file folder panel (4) of the invention.
Figure 14:
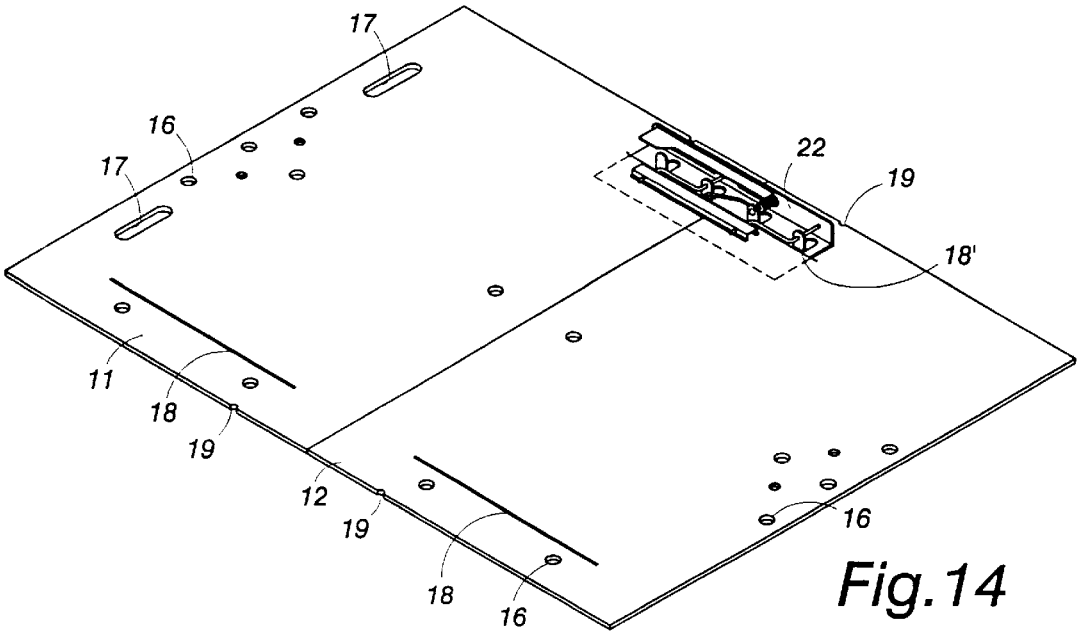
FIGS. 14 15 and 17 show the file folder panel (4) mounted with different file clips.

The file folder panel 10 as shown in FIG. 13 comprises two main file panels 11 and 12. Besides the pre-punched holes, grooves, slots and indentations, the specific feature is two section vertical slots 18' at the crease between the file panels 11 and 12. Certainly, the slot 18' can be made in a single section or multiple sections, but two sections slot is preferable. In the normal application, the two panels are foldable. In case the strong clip 22 is mounted as shown in FIG. 14, the two section slot must be cut to form a long slot for the insertion of clip strip 221 of the strong clip 22. The file panel 10 no longer permits to be folded, uniquely used as a large size single file panel.

Figure 15:
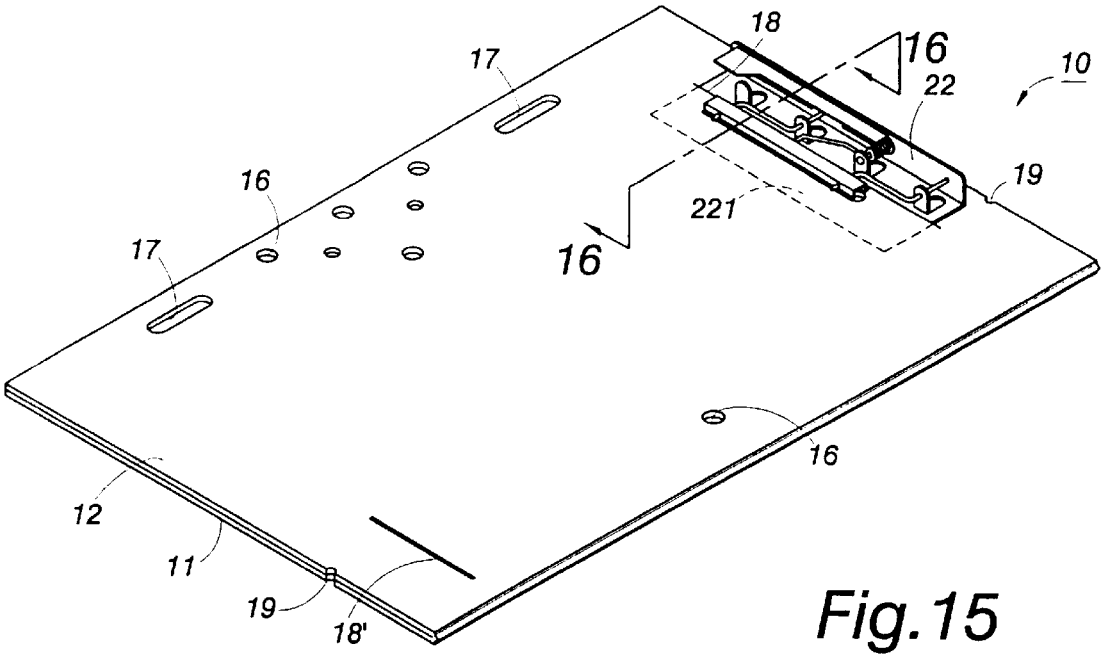
Figure 16:
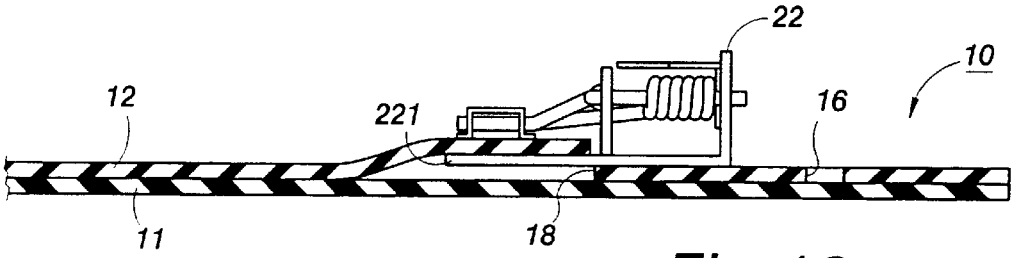
FIG. 16 is the section of FIG. 15, the file folder panel (4) mounted with file clip.
Figure 17:
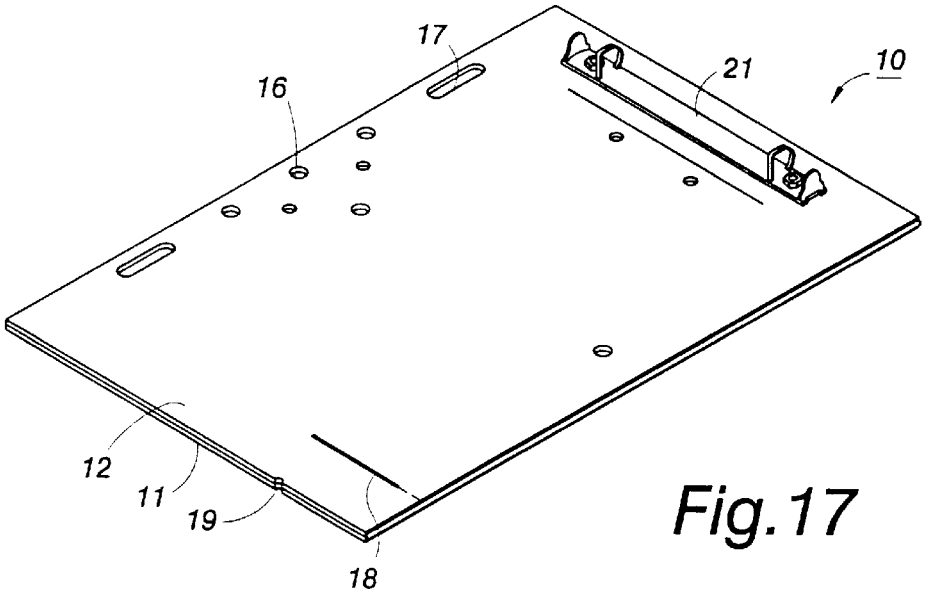
Figure 18:
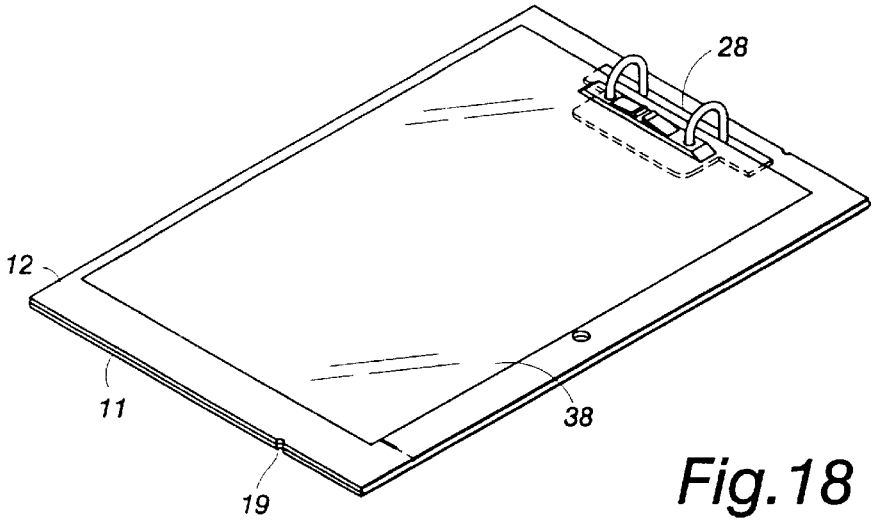
FIGS. 18 and 19 display the method of binding elastic band on the file folder panel (4)
Figure 19:
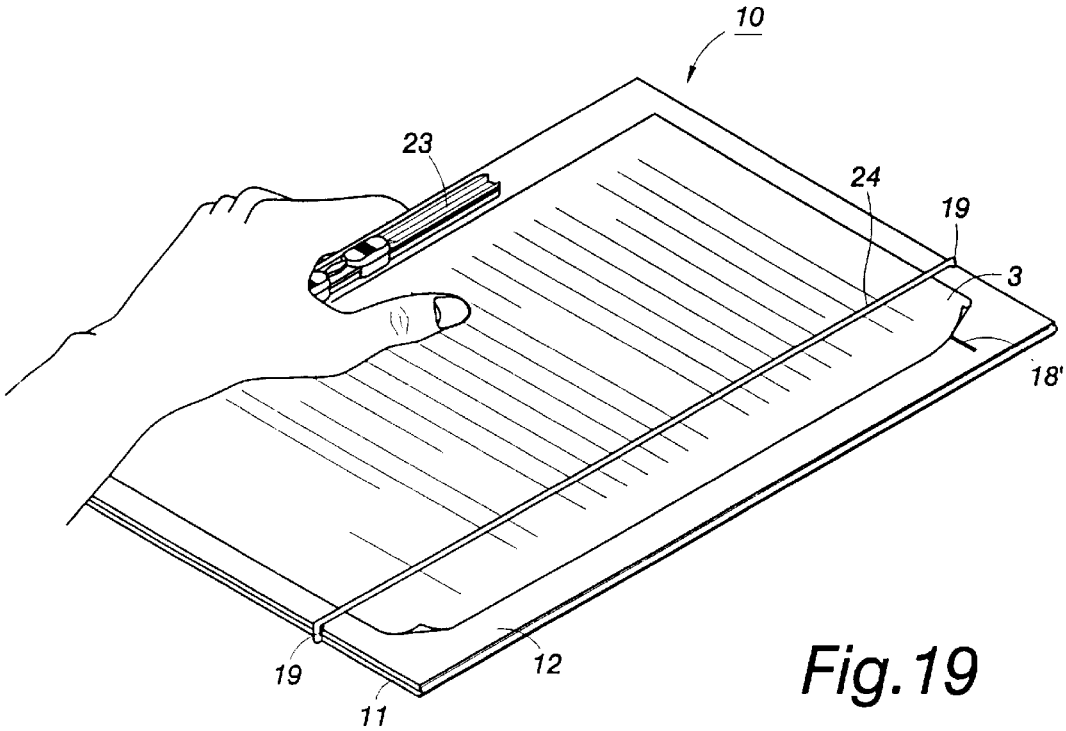
Figure 20:
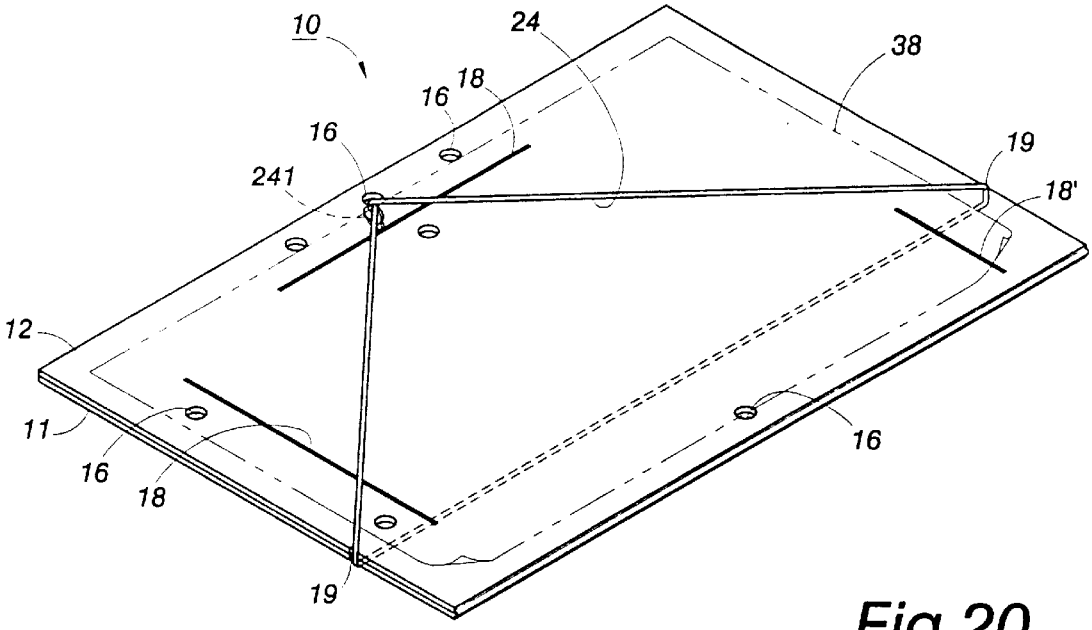
FIG. 20 shows the file folder panel (4) mounted with double file clips.

FIG. 15 is a continuation of FIG. 13 where the file folder panel 10 is folded to form a single file panel convenient for hand carrying. The clip strip 221 of the strong clip 22 is mounted in the slot 18 for holding the paper in place. There are two pre-perforated holes 16 for mounting the loose leaf file clip 21 (as shown in FIG. 17;) four pre-perforated holes 16 for the German clip 28 (as shown in FIG. 18), two perforated holes 16 for the go-through clip 23 (as shown in FIG. 19;) and four indentations 19 combined with the elastic band 24 to hold down the paper 38. Another embodiment has one hole 16, four indentations 19 and an elastic band 24 to hold down the paper 38 as shown in FIG. 20. The band knot is fixed in the hole 16.

Figure 21:
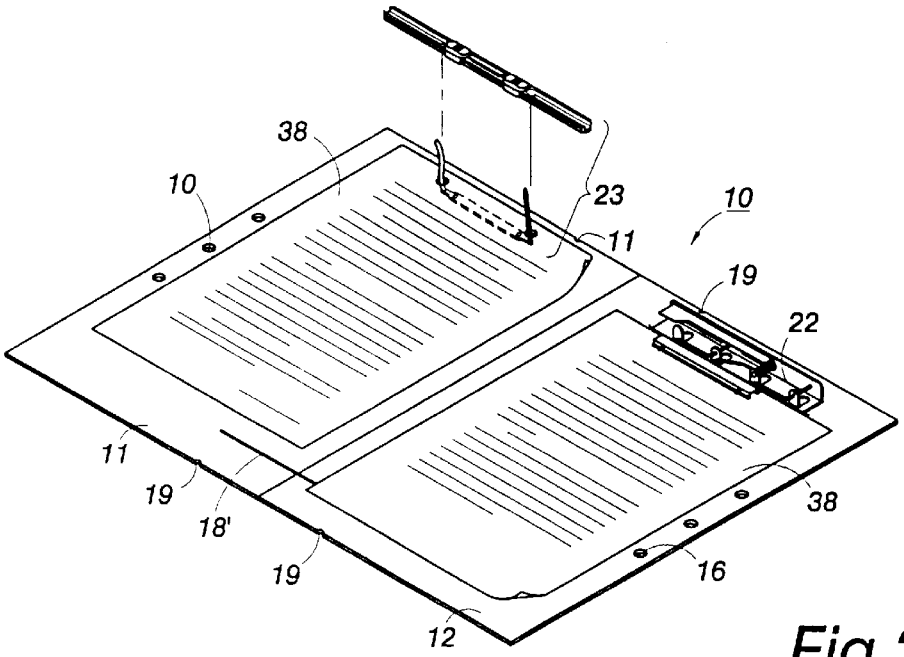
FIG. 21 displays the file folder panel (4) is in the vertical hanging position.
Figure 22:
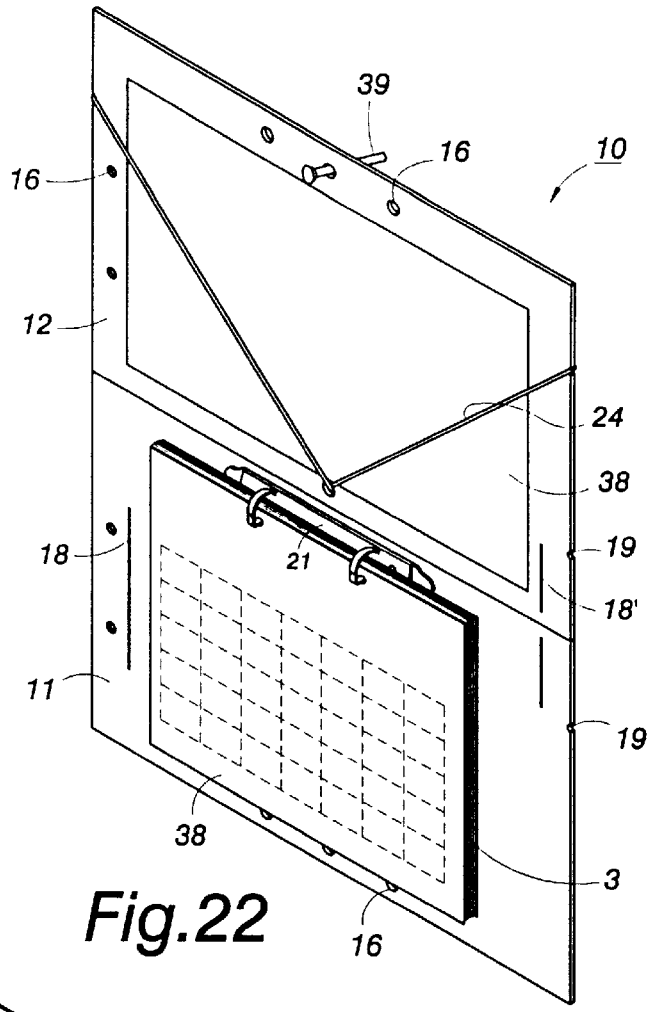
FIG. 22 shows the file folder panel (4) with the central crease mounted with the strong clip.

FIG. 21 is a continuation from the above figures. The file folder panel 10 is widely extended, the slot 18 is mounted with strong clip 22 on one panel, and two holes are mounted with the go-through clip 23 to hold down the paper 38 on the other panel. FIG. 22 shows the file folder panel with a loose leaf clip 23 holding down the paper 38 on one panel and an elastic band 24 holding down the paper 38 on the other panel, having a hanging nail 39 to hang the file panel on the wall through the hole 16.

Figure 23:
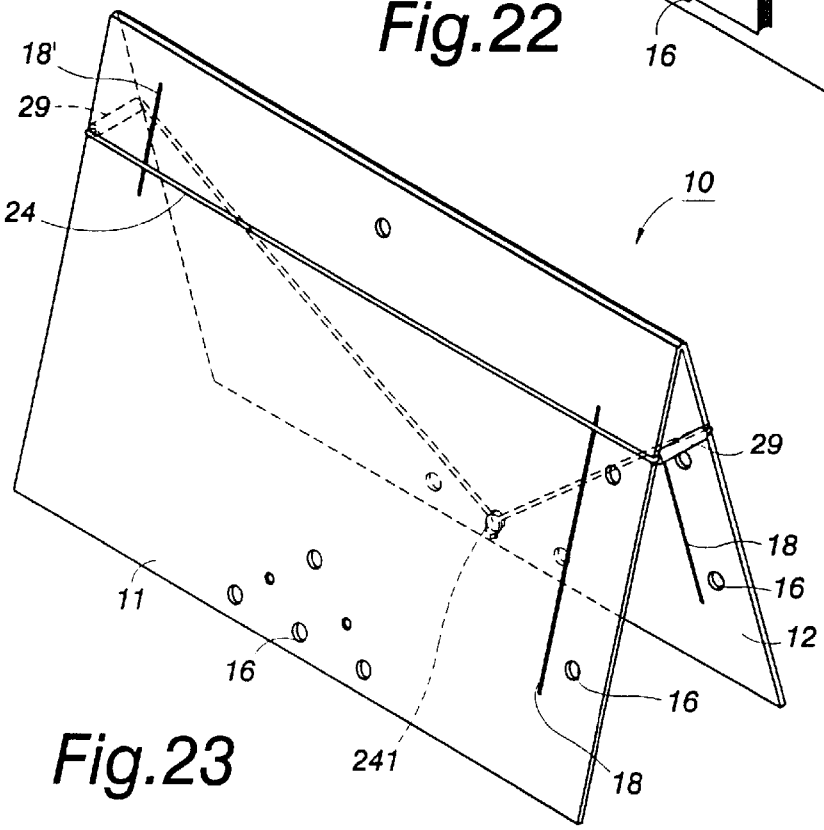
FIG. 23 shows an A-frame converted from the file folder panel (4) of the invention.

FIG. 23 demonstrates that the file folder panel 10 is arranged in A-frame with an elastic band 24 binding through the hole 16 and the slot 19 to hold down the paper which serves as the message memo. Both ends of the elastic band are sleeved with a short segment of tube 29 to brace and separate the main panels 11 and 12 apart, so the file folder panel 10 forms a set message memo pad.

Figure 24:
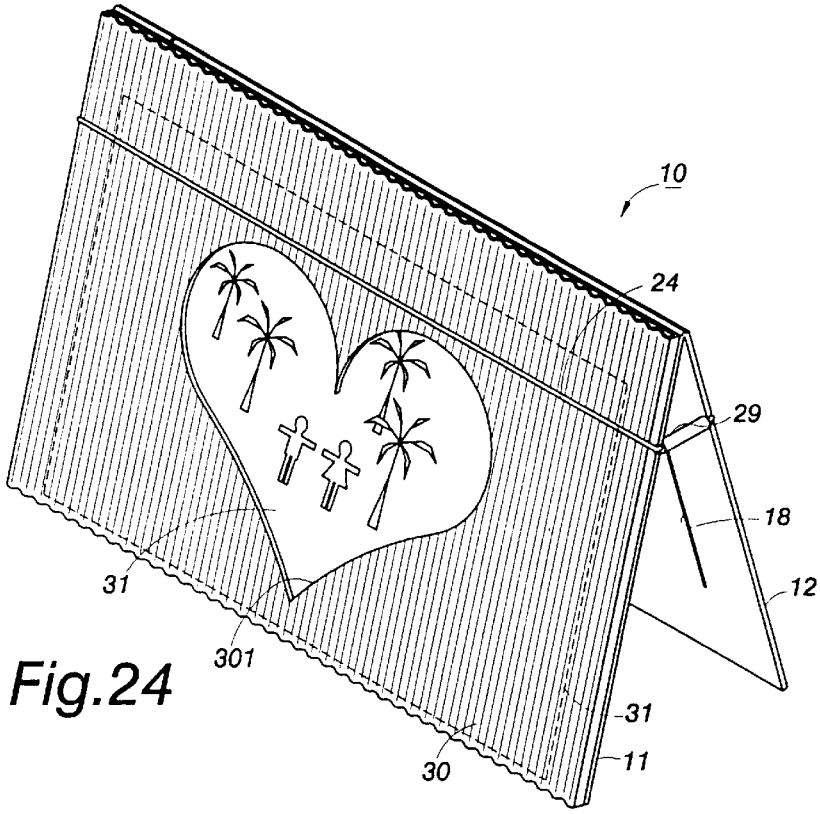
FIG. 24 exhibits the photo frame or painting frame in flat position converted from the file folder panel (4) of the invention.

FIG. 24 continues the embodiment of FIG. 23, a piece of decoration board 30 (for example, a corrugated board) in diverse color, shape or pattern is posted on the face of the file folder panel 10, held by a elastic band 24. A picture may be interposed between the decoration board 30 and the file folder panel 10 and a proper viewing window 301 is cut on the decoration board 30 to display the picture. That is to say it forms a photo frame or and painting frame.

Figure 25:
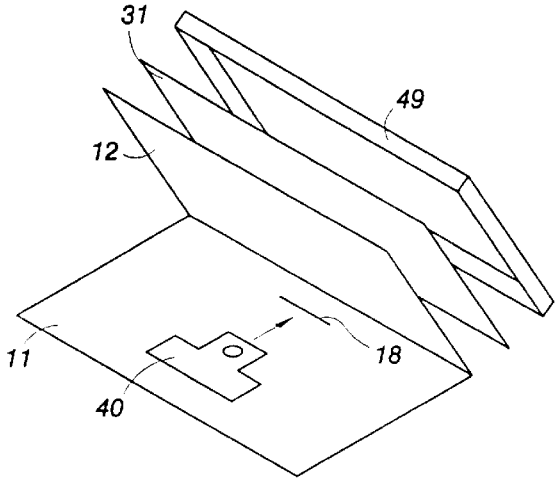
FIG. 25 displays the hanging photo frame or painting frame from the file folder panel (4) of the invention.
Figure 26:
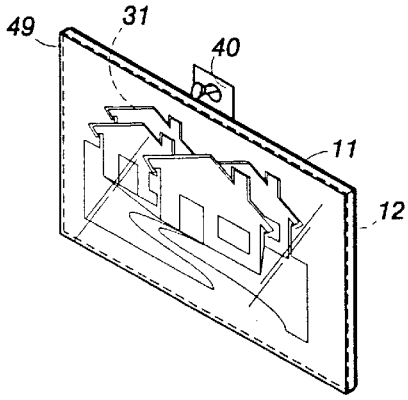
FIG. 26 shows a restaurant menu from the file folder panel (4) of the invention.

FIGS. 25 and 26 show the disassembly and assembled photo frame or painting frame in which the inverted T-shape hanger 40 is inserted through the slot 18 to facilitate the file folder panel 10 being hanged on the wall. The picture 31 is therefore posted on the file panel 12 by glue, adhesive tape, or transparent cover 49.

Figure 27:
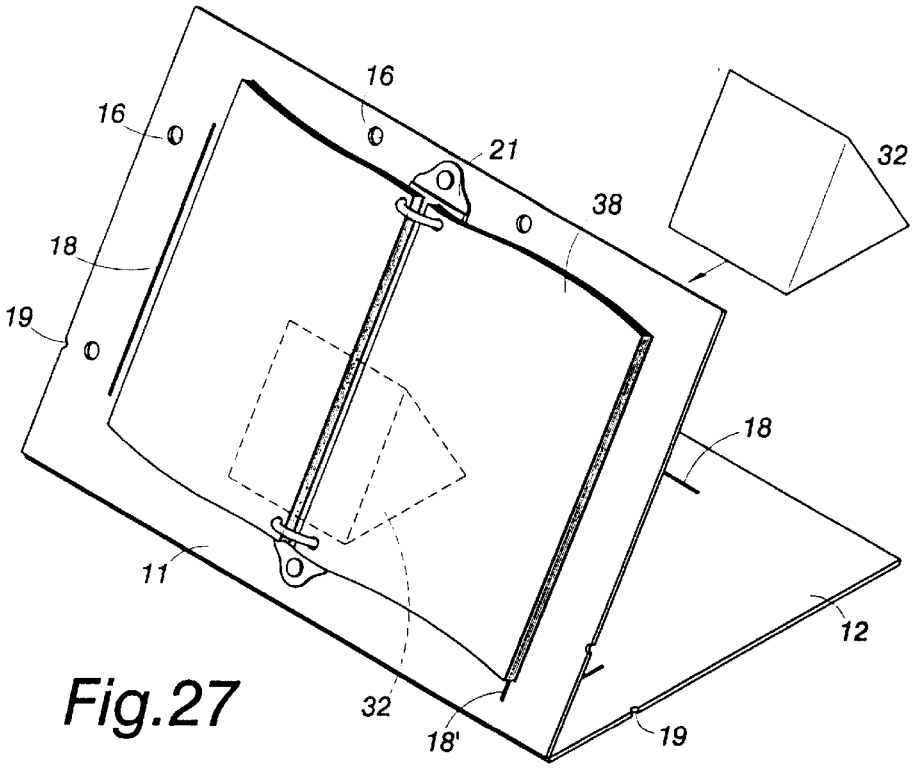
FIG. 27 illustrates the month calendar from the file folder panel (4) of the invention.

FIG. 27 shows a restaurant menu converting the file folder panel 10 into triangular frame with a triangular block support 31 on the back of the file panel 11. The pre-perforated holes 16 are mounted with a loose leaf clip to hold down the menu paper 38. It can be set on the dinning table convenient for the customers to read over.

Figure 28:
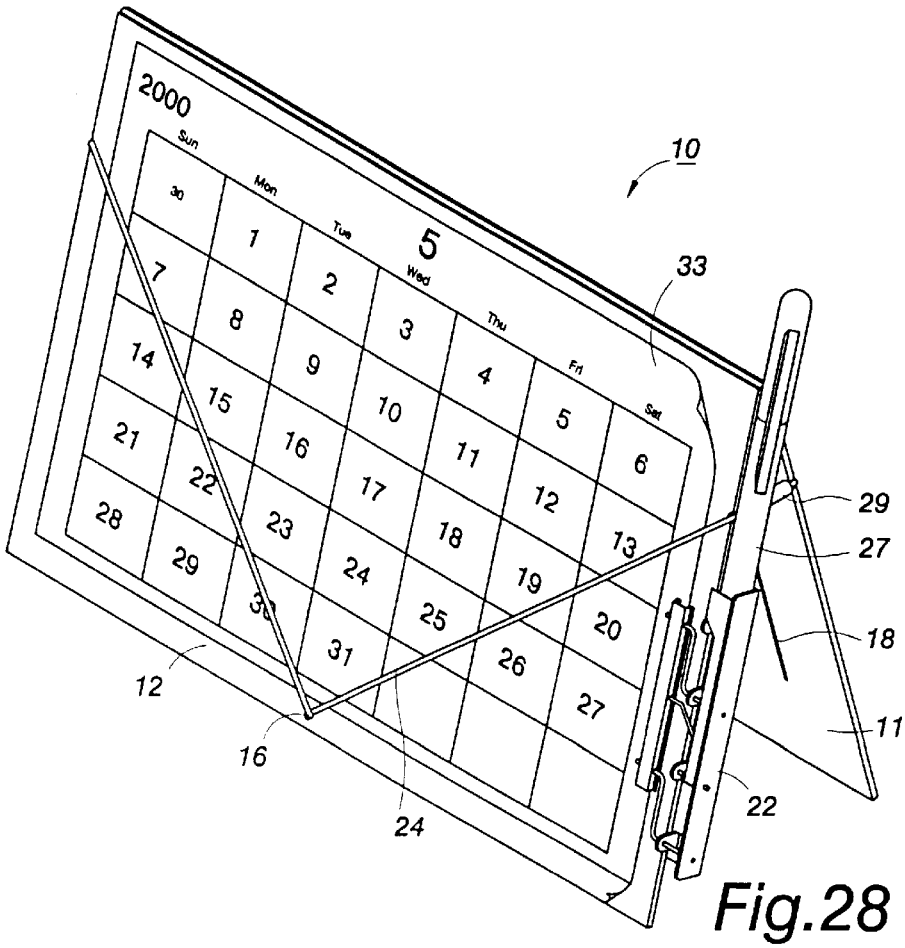
FIG. 28 displays a memo pad from the file folder panel (4) of the invention.

FIG. 28 illustrates a month calendar frame, the month calendar 33 is held by a elastic band 24 on the file panel 12. The month calendar is further clamped by the strong clip 22, which serves as a ball pen holder 27.

Figure 29:
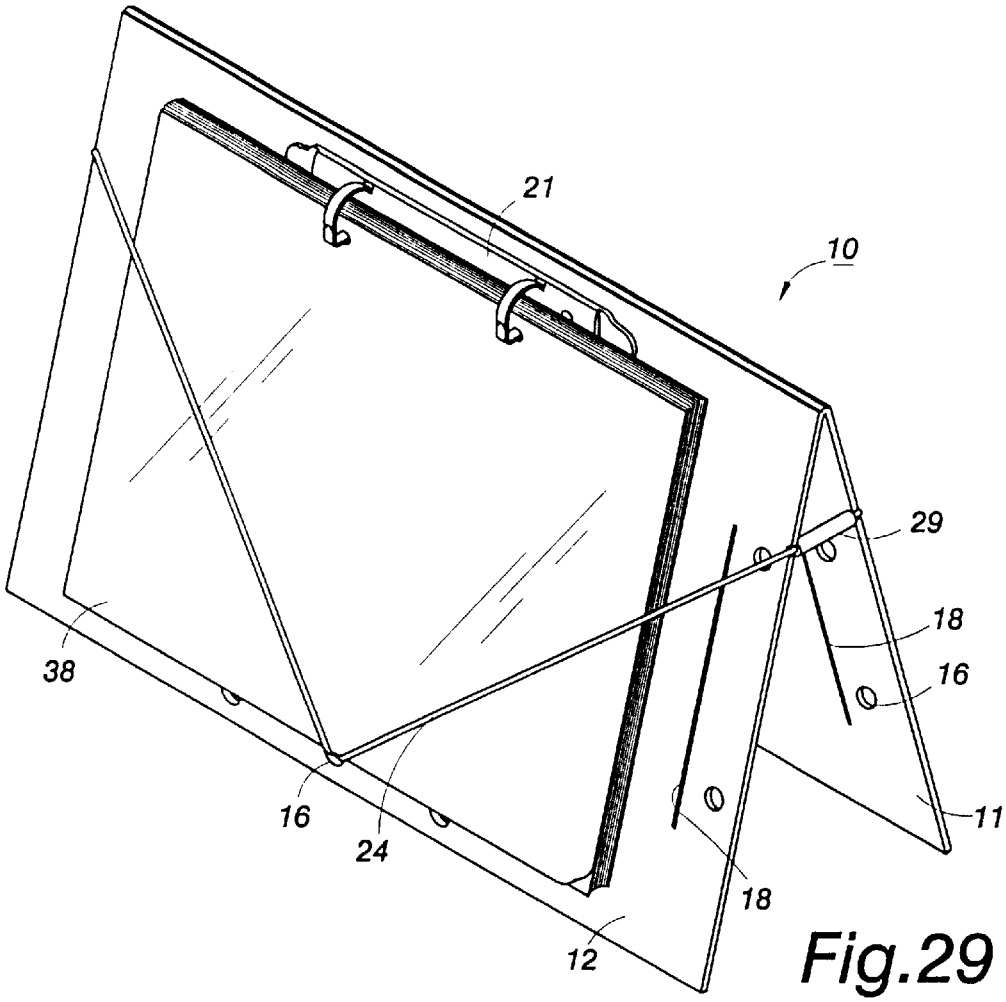
FIG. 29 shows a loose leaf pad from the file folder panel (5) of the invention.

FIG. 29 shows a memo pad, in which the go-through clip 23 is mounted on the file panel 12 and holds down the scrap paper 38 in place. The elastic band is to reinforce the holding force to prevent the paper from being blown off.

Figure 30:
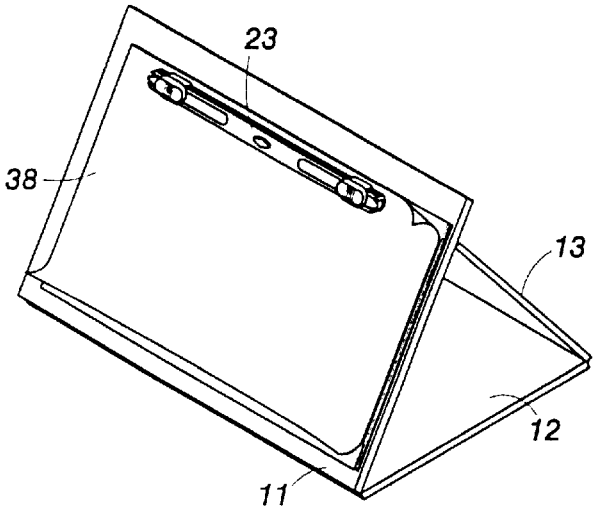
FIG. 30 displays the file folder panel is laminated with two thin paper on its front and back.

FIG. 30 is a loose leaf pad formed by three pieces of file panel. the file folder panel 10 is folded up into triangle by the file panels 11 and 12. The file panel 12 serves the bottom and the go-through clip 23 is mounted on the file panel 11 to hold down the paper 38. The file panel 13 supports the go-through clip 23 on its back.

Figure 31:
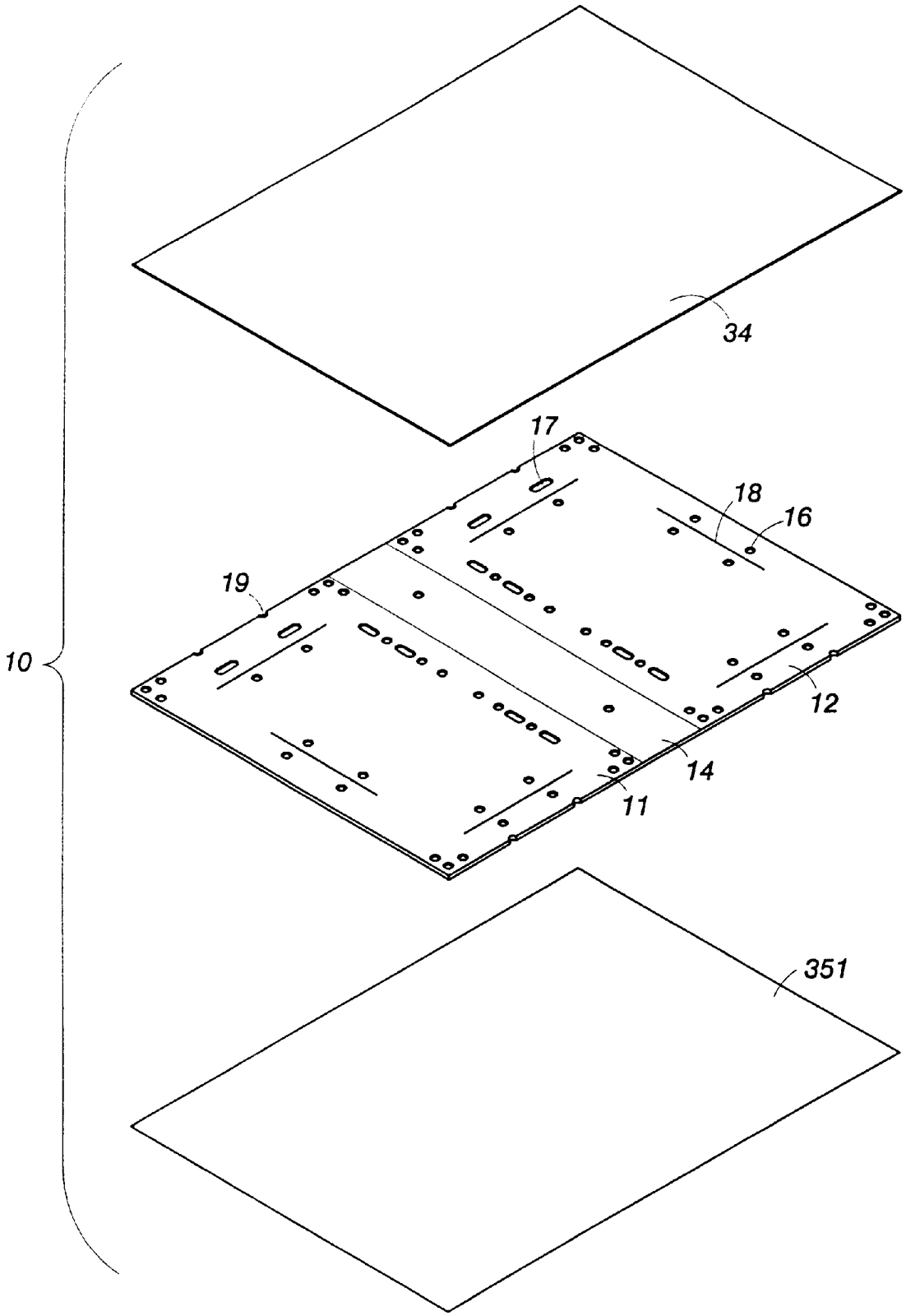
FIG. 31 illustrates a diagram of the file folder panel in FIG. 30 mounted with different clips.
Figure 32:
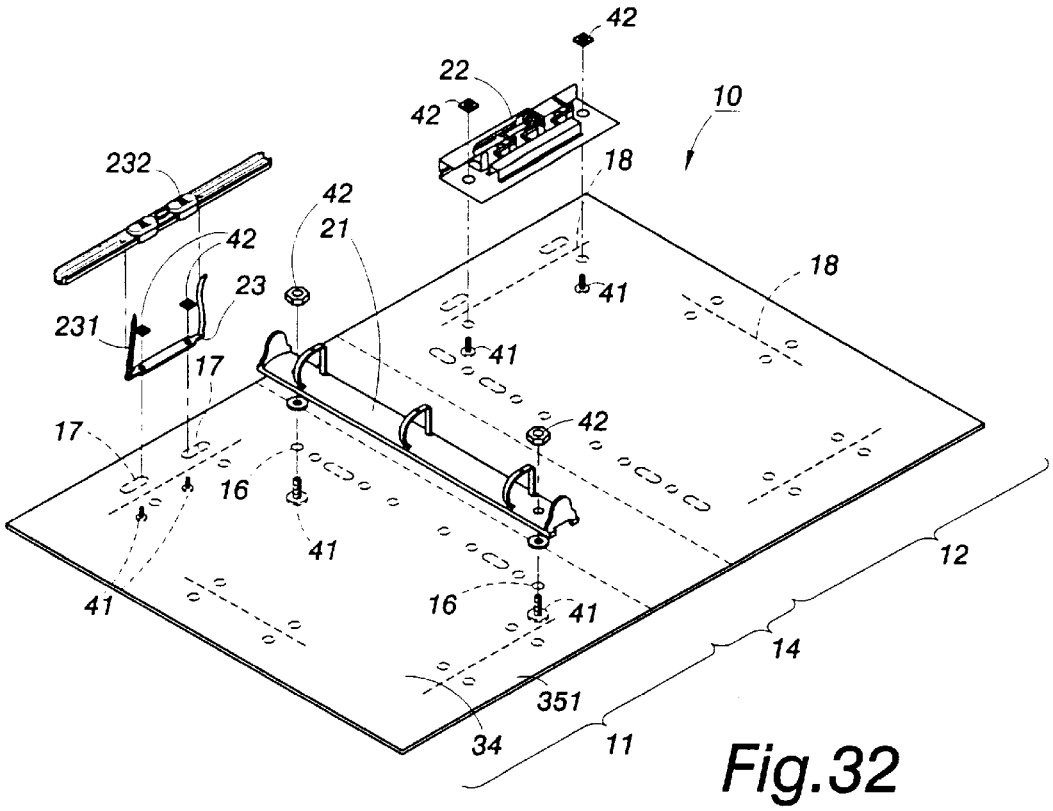
FIG. 32 displays the visual observation over the unused holes, grooves, slots and indentations on the file folder panel.

As shown on the file folder panel 10, there are many holes, grooves, slots and indentations are used up, many of them remain unused, giving the viewers a bad feeling. To remove such bad feeling, as shown in FIG. 31, both the front and the back of the file folder panel 30 is laminated a layer of thin paper 34 and 35 in similar size, large enough to cover the face of file folder panel 10. Upon the completion of lamination, as shown in FIG. 32, all unused holes, grooves, slots and indentations are hidden up, it presents good looking. In addition, the size of the thin paper can be set larger than the area of the file folder panel 10, there is enough margin to wrap up the borders of the file panels 11, 12, and 14 (not shown in the figure) to produce beauty for the panel borders.

Figure 33:
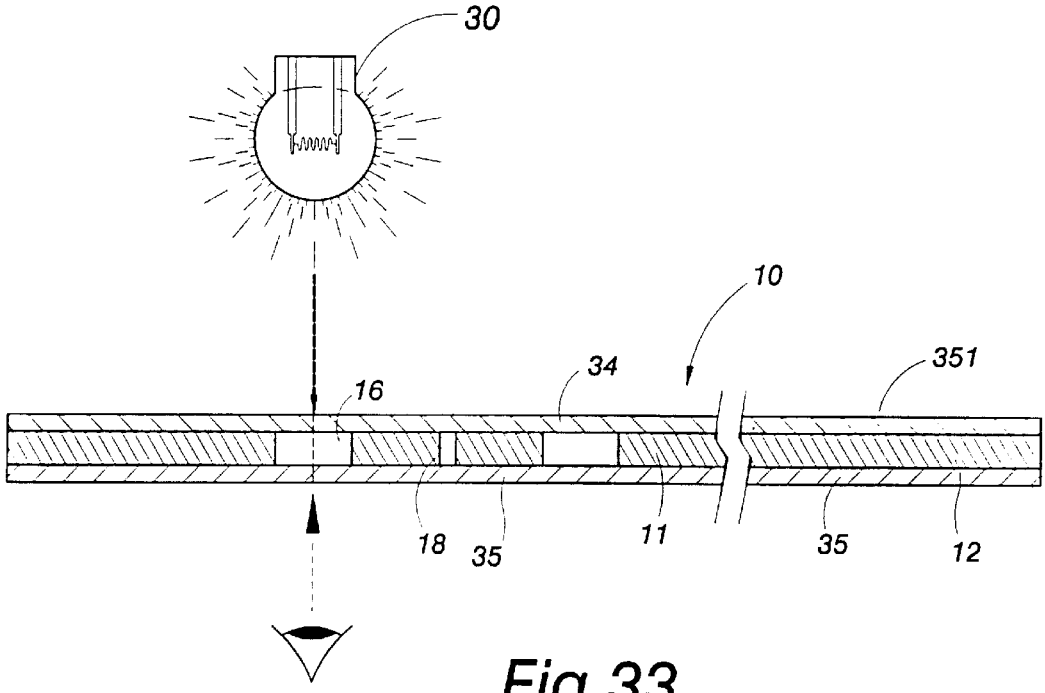
FIG. 33 shows the form of file folder panel mounted with two kind of clip suitable for holding Western and Chinese documents.

FIG. 33 is the section of FIG. 32. When it is put under the lamp or sunlight, the unused holes, grooves, slots and indentations are still visible through the thin papers 34 and 35. Using a ballpoint pen to pierce through the holes, groove, slots and indentations, they reemerge, you can use the clip, the elastic band and other fixing element to change the application of the file folder panel 10 as you wish.

Figure 34:
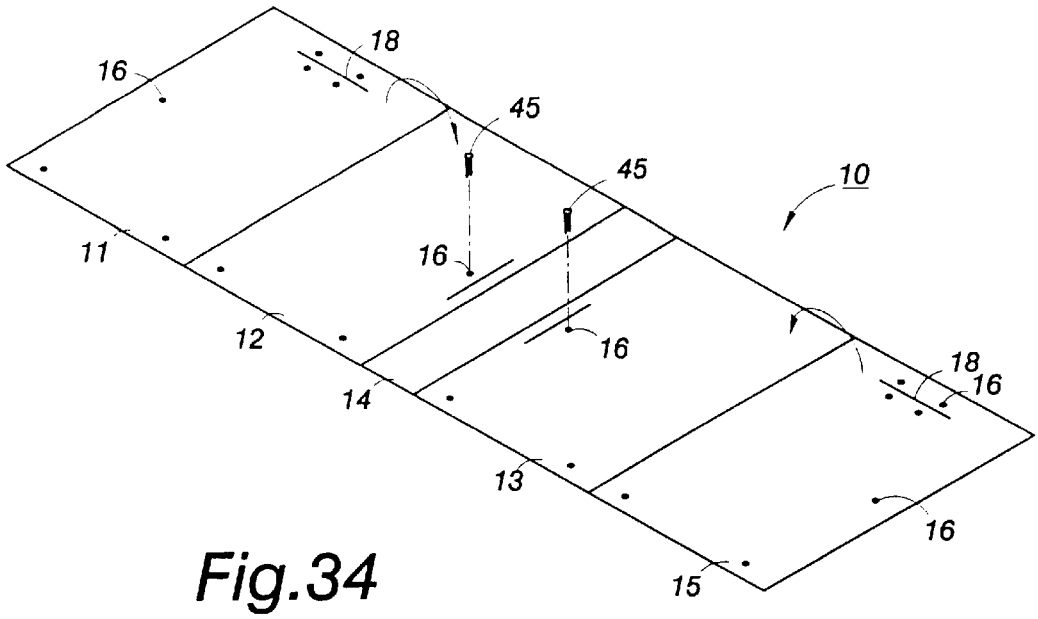
FIG. 34 shows the extension diagram of the file folder panel (6) of the invention.
Figure 35:
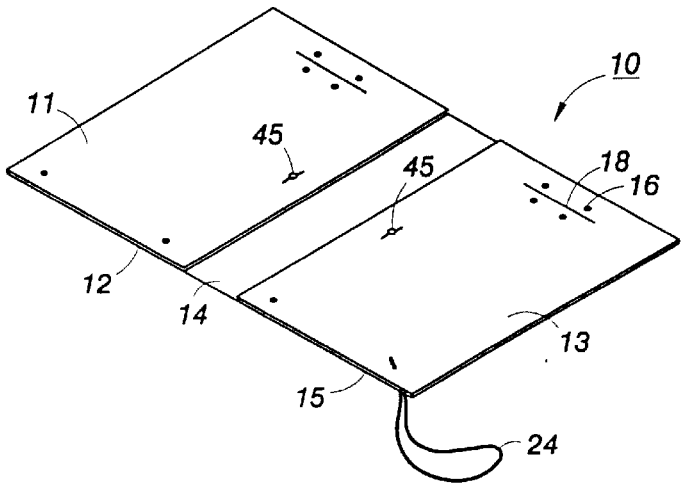
FIG. 35 illustrates the fold up diagram of the file folder panel (6) of the invention.

The file folder panels 10 shown in FIG. 34 comprise four main file panels, 11, 12, 13, 15 and a spine panel 14 which is set in the center. The file panels 11 and 15 are inward folded onto the file panels 12 and 13 as shown in FIG. 35. Then insert two staples 45 through the holes 16 to hold two file panels firmly together. Other file clips and elastic bands can be added to suit the application as is desired.

Figure 36:
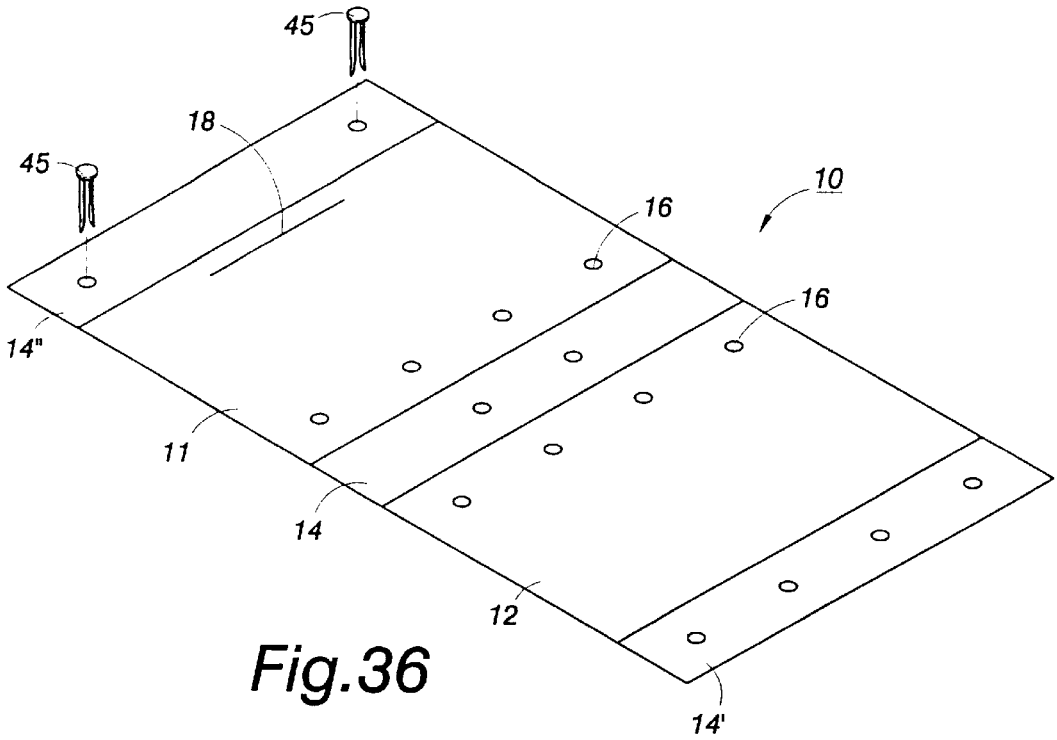
FIG. 36 shows the extension diagram of the file folder panel (7) of the invention.
Figure 37:
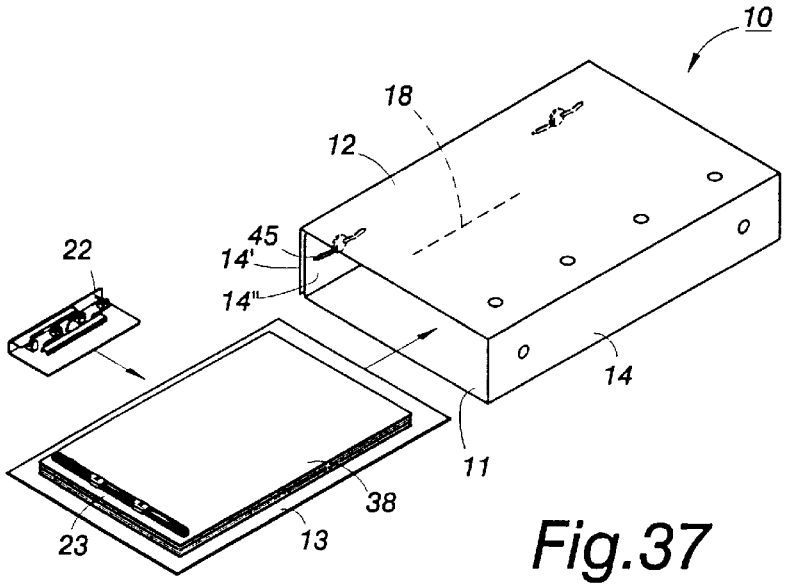
FIG. 37 illustrates the diagram of the single file folder panel (7) of the invention.
Figure 38:
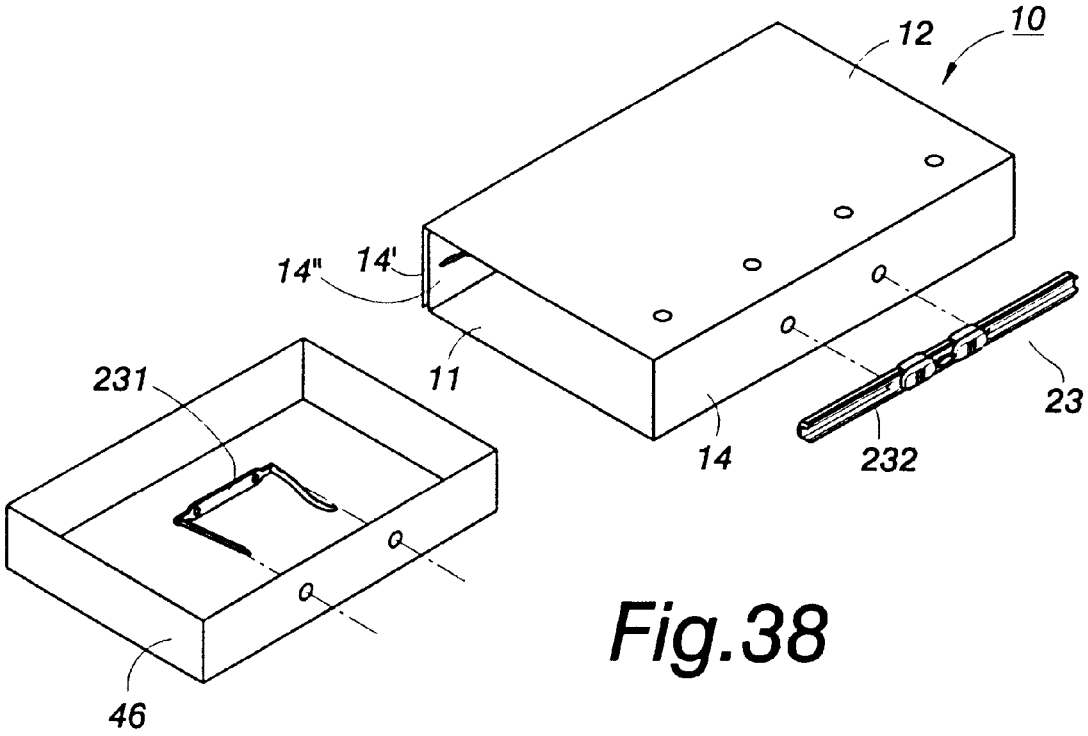
FIG. 38 shows diagram of box from the file folder panel (7) of the invention.
Figure 39:
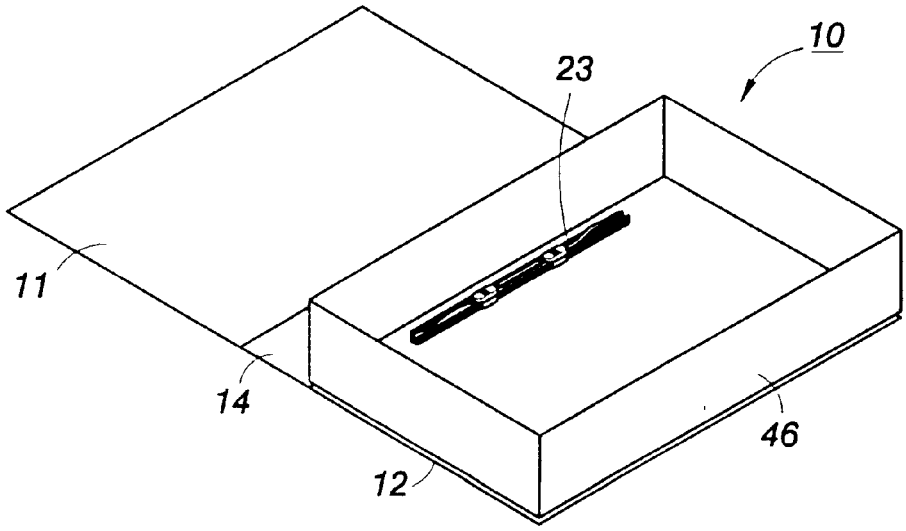
FIG. 39 illustrates the diagram of box from the file folder panel (8) of the invention.

The file folder panel 10 illustrated in FIG. 36 consists of two main file panels 11 and 12, and three spine panels 14, 14' and 14". Besides the application mentioned in the previous paragraphs, it can form a box for storing single panel 13 as shown in FIG. 37. A strong clip 22 is inserted through the slot 18 to hold the file panel 13 in the box. The box 46 is further mounted with a go-through slip to form a hand carrying brief case.

Figure 40:
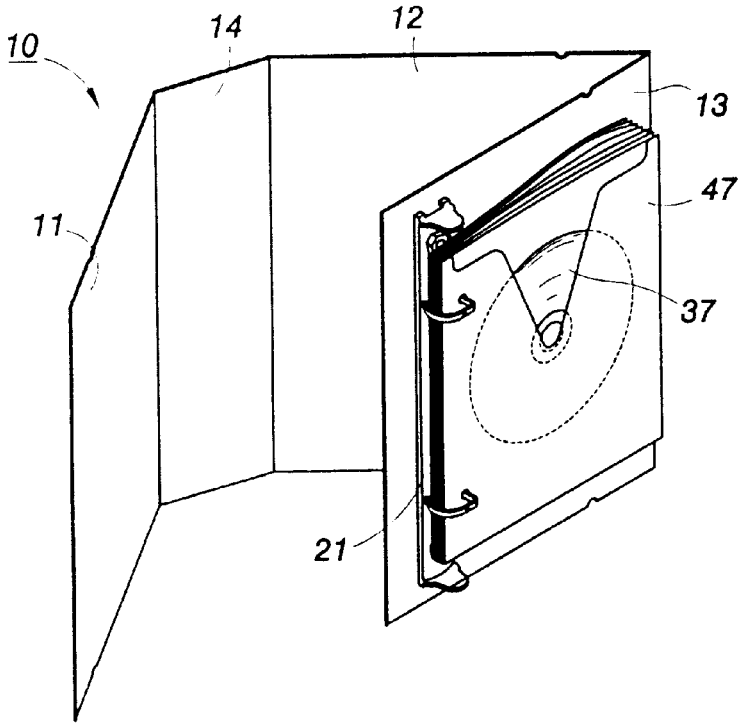
FIG. 40 shows the CD pocket cabinet from the file folder panel (9) of the invention.
Figure 41:
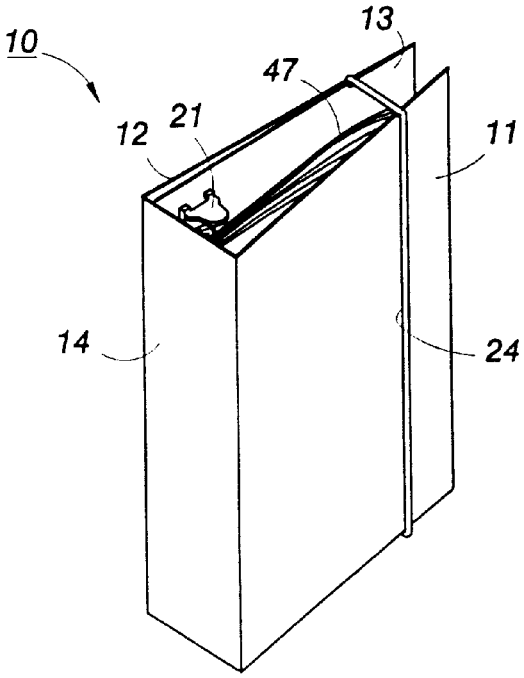
FIG. 41 displays the file folder panel (9) shown in FIG. 40 mounted with elastic band.

FIG. 40 shows a file folder panel 10 comprising three main file panels 11, 12, 13 and a spine panel 14. The spine panel is interposed between the file panels 11 and 12. The file panel 13 is mounted with a loose leaf clip which holds a plurality of CD pockets 47 for storing CD 37 to serves as CD bank. In addition, it is necessary to reinforce the holding force by an elastic band 24 as shown in FIG. 41.

Viewing from the aforementioned statement, it is clear understood that the file folder panel of the invention consists of a single piece of file panel, or more than one file panel and spine panel. The holes, grooves, slots and indentations punched on the file panel, combined with different clips of varying size and elastic band, can accomplish many useful applications.

What is claimed is:

1. A file folder comprising a first panel, a second panel, a third panel connected with one side edge of said second panel, and a fourth panel formed between said first and second panels, said fourth panel serving as a spine,. said first panel being provided with an extended flap, said extended flap forming a file clip region having a plurality of pre-perforated holes and grooves, said extended flap having a plurality of holes on a crease between said extended flap and. said first panel, said second panel having a plurality of indentations, and said third panel having a plurality of slots, indentations, grooves and pre-perforated holes, whereby said pre-perforated holes, grooves and slots are fit for installing a variety of file clips and permitting fixing and winding an elastic band, said flap allowing said file clips and elastic band to band together after being erected up in place.

* * * * *